US010168013B1

(12) United States Patent
Li et al.

(10) Patent No.: US 10,168,013 B1
(45) Date of Patent: Jan. 1, 2019

(54) LIGHT MODULE OF LASER HEADLAMP WITH LIGHT CIRCULATION EFFECT

(71) Applicant: TAN DE TECH CO., LTD., Yunlin County (TW)

(72) Inventors: Tsung Hsien Li, Yunlin County (TW); Chung Chiang Pan, Yunlin County (TW); Cheng Chih Lai, Yunlin County (TW); Chao Pai Lee, Yunlin County (TW)

(73) Assignee: Tan De Tech Co., Ltd., Douliu (TW)

( * ) Notice: Subject to any disclaimer, the term of this patent is extended or adjusted under 35 U.S.C. 154(b) by 0 days.

(21) Appl. No.: 15/966,942

(22) Filed: Apr. 30, 2018

(51) Int. Cl.

| | |
|---|---|
| ***F21S 41/16*** | (2018.01) |
| ***F21S 41/176*** | (2018.01) |
| ***F21V 29/10*** | (2015.01) |
| ***F21S 41/32*** | (2018.01) |
| ***F21S 41/25*** | (2018.01) |
| ***F21S 41/36*** | (2018.01) |

(52) U.S. Cl.
CPC ..... *F21S 41/16* (2018.01); *F21S 41/176* (2018.01); *F21S 41/25* (2018.01); *F21S 41/321* (2018.01); *F21S 41/36* (2018.01); *F21V 29/10* (2015.01)

(58) Field of Classification Search
CPC ..... F21S 41/16; F21S 41/25; F21S 41/176; F21S 41/36; F21S 41/321; F21S 41/323; F21S 41/331; F21S 41/332; F21S 41/333
USPC ..... 362/510, 553, 549–549
See application file for complete search history.

(56) References Cited

U.S. PATENT DOCUMENTS

2004/0218400 A1* 11/2004 Egashira ..... B60Q 1/2607 362/520
2008/0310141 A1* 12/2008 Mezouari ..... G01D 11/28 362/23.19
2014/0268837 A1* 9/2014 Simchak ..... B60Q 1/12 362/465

FOREIGN PATENT DOCUMENTS

EP 0 206 908 * 12/1986

* cited by examiner

*Primary Examiner* — Laura Tso
(74) *Attorney, Agent, or Firm* — Wang Law Firm, Inc.

(57) ABSTRACT

A light module of a headlamp includes several laser emitters, several collimators, a light circulating device, a liquid crystal panel, and a projection lens in sequence. The light circulating device includes a filter, a first polarizer, a first reflector, a wavelength transforming layer, a second reflector, and a second polarizer to convert laser rays of the laser emitters into white laser rays with a predetermined polarization for the liquid crystal panel, and finally to project out through the projection lens.

9 Claims, 2 Drawing Sheets

LIGHT MODULE OF LASER HEADLAMP WITH LIGHT CIRCULATION EFFECT

BACKGROUND OF THE INVENTION

1. Technical Field

The invention relates to a headlamp of a vehicle, and more particularly to a light module of a headlamp with light circulation effect.

2. Description of Related Art

Illumination of vehicles is very important issue to driving safety. It is not only to provide a bright light, but also to increase the safety when one is driving in the dark as well as saving power.

In early days, light bubbles are used to be the light modules of the headlamps, and then high-intensity discharge lamps (HID lamps) are produced in the market that produces light by passing electricity through ionized xenon gas at high pressure. It produces a bright white light that closely mimics natural sunlight, which extends its applications into the film, and daylight simulation industries, and then LED headlamps are invented. The newest headlamp is laser headlamp. Compare with LED headlamps, the laser headlamp has a distance of visual cognition 1.5 times longer than that of the LED headlamp, 1/10 in size, and 2.5 times of luminance, so that the laser headlamps are smaller and lighter than any conventional headlamps.

However, there still are some unsolved problems in the laser headlamps, including reliability in anti-vibration and heat-resist, heat dissipation, and so on. The technicians are working hard to solve these problems.

BRIEF SUMMARY OF THE INVENTION

In view of the above, the primary objective of the present invention is to provide a lamp module of a laser headlamp, which has a high usage rate of light and a low heat generation.

In order to achieve the objective of the present invention, a light module of a laser headlamp includes at least a laser emitter, a light circulating device, a liquid crystal panel, and a projection lens in sequence. The laser emitter produces laser rays with a wavelength in a predetermined range. The light circulating device includes a first polarizer, a first reflector, a wavelength converting layer, a second reflector, and a second polarizer in sequence from an end proximal to the laser emitter to an end proximal to the liquid crystal panel. The first reflector lets the laser rays with a first polarization pass; the first reflector reflects the laser rays from the first polarizer to the wavelength converting layer, and reflect the laser rays from the wavelength converting layer to the first polarizer; the wavelength converting layer converts the laser rays into white laser rays; the second reflector reflects the white laser rays from the wavelength converting layer to the second polarizer, and reflect the white laser rays from the second polarizer to the wavelength converting layer; and the second reflector lets the white laser rays with a second polarization pass. The liquid crystal panel lets the white laser rays from the light circulating device pass, and generates projection rays with a predetermined image. The projection lens projects the projection rays with the predetermined image onto a target.

As a result, the present invention may increase the usage rate of laser rays and reduce the heat generation.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
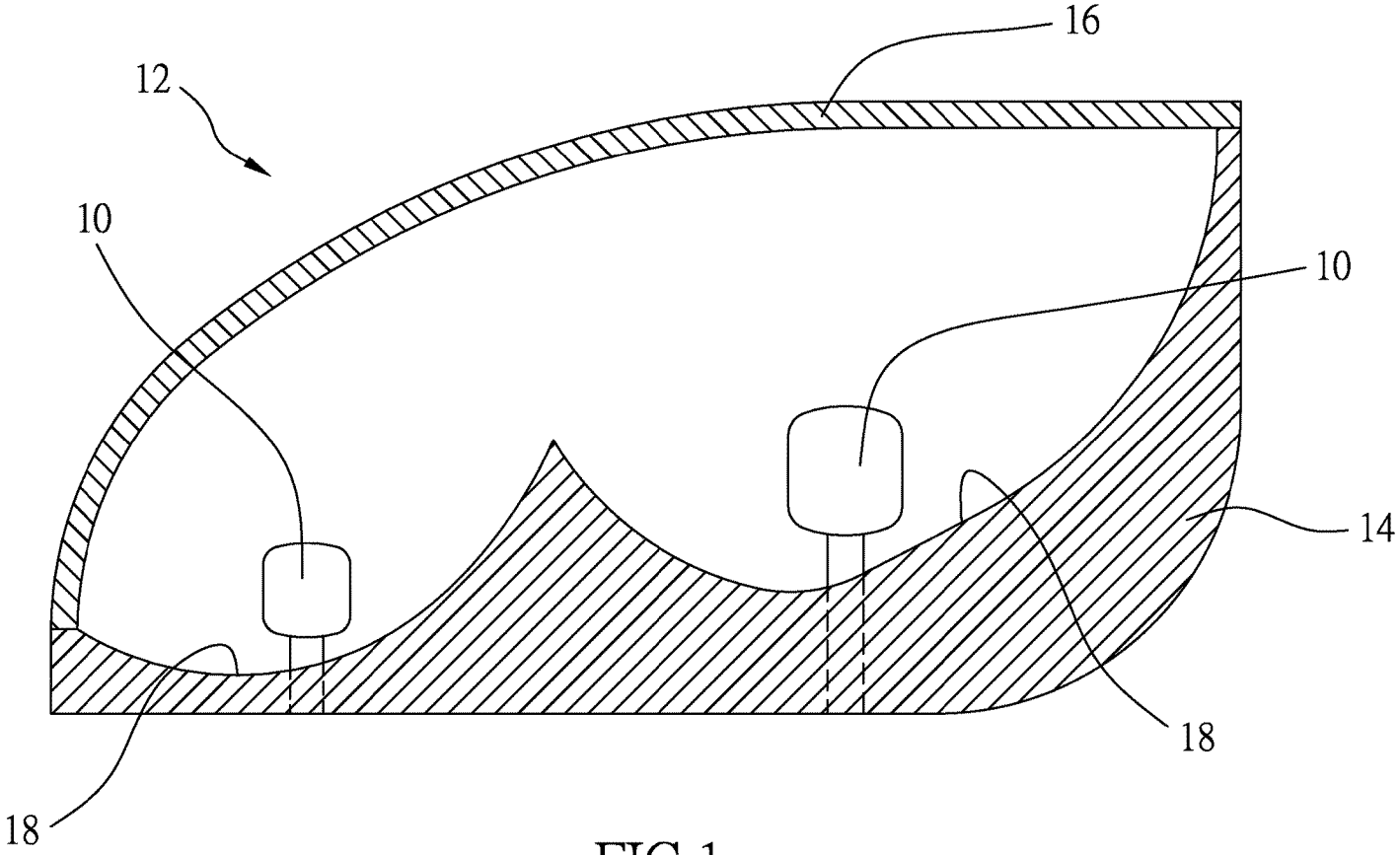
FIG. 1 is a sectional view of the laser headlamp of a preferred embodiment of the present invention.

FIG. 1 shows a lase headlamp 12 of a vehicle, including a base 12, a lamp cap 16, and two light modules 10. The base 12 has two concave reflection portions 18. The lamp cap 16 is made of a transparent material and is connected to the base 12 to form a chamber therein. The light modules 10 are provided at the reflection portions 18 of the base 12.

Figure 2:
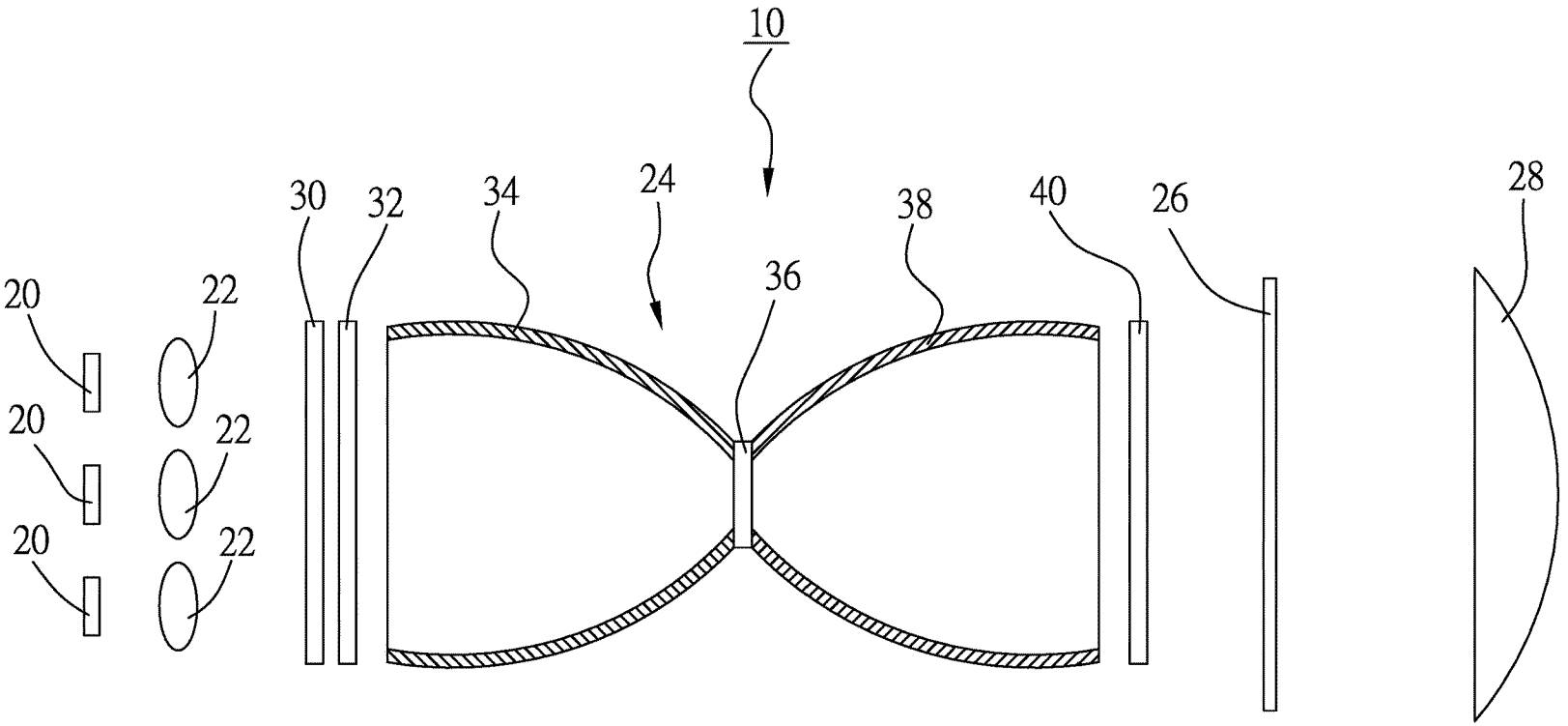
FIG. 2 is a sectional view of the light module of the preferred embodiment of the present invention.

As shown in FIG. 2, each of the light modules 10 includes a plurality of laser emitters 20, a plurality of collimators 22, a light circulating device 24, a liquid crystal panel 26, and a projection lens 28 in sequence.

In the present embodiment, the laser emitters 20 produce blue laser rays with a wavelength between 360 nm and 480 nm. The collimators 22 are provided in front of the laser emitters 20 respectively to collimate the laser rays, so that parallel laser rays will enter the light circulating device 24.

The light circulating device 24 includes a filter 30, a first polarizer 32, a first reflector 34, a wavelength converting layer 36, a second reflector 38, and a second polarizer 40 in sequence.

The parallel laser rays pass through the filter 30 first to filter out the laser rays in a predetermined wavelength range. In the present embodiment, the filter 30 is a short pass filter, only allowing the laser rays with a wavelength shorter than a predetermined threshold passing.

Next, the laser rays arrive at the first polarizer 32. The first polarizer 32 lets the laser rays with a first polarization pass, and then the parallel laser rays with the first polarization emit to the wavelength converting layer 36.

The first reflector 34 is located between the first polarizer 32 and the wavelength converting layer 36 to reflect the laser rays from the first polarizer 32 to the wavelength converting layer 36, and to reflect the laser rays from the wavelength converting layer 36 to the first polarizer 32. It is noted that the laser rays may be reflected by the first reflector 34 for several times before arrive at the destination. In the present embodiment, the first reflector 34 is a barrel-like member with a diameter gradually narrowing from an end proximal to the first polarizer 32 to an end proximal to the wavelength converting layer 36. In precisely, the first reflector 34 is a compound parabolic concentrator, which means that an interior surface of the barrel-like member is a paraboloid to concentrate the laser rays from the first polarizer 32 to the wavelength converting layer 36. It reflects the laser rays from the wavelength converting layer 36 to the first polarizer 32 as well.

The wavelength converting layer 36 changes the wavelength of the laser rays passing therethrough to generate white light. In the present embodiment, the wavelength converting layer 36 contains phosphor therein to excite the laser rays, and the blue laser rays will be converted into white laser rays with predetermined polarization. Some of the laser rays will pass through the wavelength converting layer 36, and some of them are reflected by the phosphor. In other words, except that the laser rays are converted from blue light to white light in the wavelength converting layer 36, some of the laser rays emit toward the second polarizer 40, and some of them emit back toward the first polarizer 32.

The reflected white laser rays emit to the first polarizer 32 directly or by reflection of the first reflector 34. The first polarizer 32 lets the white laser rays with the first polarization pass, and reflects the rest white laser rays. Some of the white laser rays passing through the first polarizer 32 are reflected by the filter 30 and pass through the first polarizer 32 again, and then the white laser rays will emit toward the wavelength converting layer 36 as described above.

The white laser rays pass through the wavelength converting layer 36 will emit to the second reflector 38 directly or by reflection of the second polarizer 40. In the present embodiment, the second polarizer 40 is a compound parabolic concentrator as well with a parabolic interior surface to concentrate the laser rays from wavelength converting layer 36 to the second reflector 38. The second polarizer 40 has a barrel-like member with a diameter gradually narrowing from an end proximal to the second polarizer 40 to an end proximal to the wavelength converting layer 36. The second polarizer 40 lets the white laser rays with a second polarization pass and leave the light circulating device 24. In the present embodiment, the first polarization is the same as the second polarization, and the first polarization is not the same as the second polarization in another embodiment.

The white laser rays reflected by the second polarizer 40 will emit back to the wavelength converting layer 36, some of them pass through the wavelength converting layer 36 and some of them are reflected.

The laser rays repeatedly travel in the light circulating device 24 as described above, and finally most of them will be converted into the white laser rays with the second polarization and emit to the liquid crystal panel 26.

The white laser rays passing through the liquid crystal panel 26 to generate projection rays with a predetermined image (not shown), and then the projection rays are projected onto a target through the projection lens 28.

In conclusion, the present invention provides the light circulating device 24 to have a high usage rate of laser rays, so that the present invention will have a low heat generation.

It must be pointed out that the embodiments described above are only some preferred embodiments of the present invention. All equivalent structures which employ the concepts disclosed in this specification and the appended claims should fall within the scope of the present invention.

What is claimed is:

1. A light module of a laser headlamp, comprising at least a laser emitter, a light circulating device, a liquid crystal panel, and a projection lens in sequence, wherein the laser emitter produces laser rays with a wavelength in a predetermined range;

the light circulating device includes a first polarizer, a first reflector, a wavelength converting layer, a second reflector, and a second polarizer in sequence from an end proximal to the laser emitter to an end proximal to the liquid crystal panel, wherein the first reflector lets the laser rays with a first polarization pass;

the first reflector reflects the laser rays from the first polarizer to the wavelength converting layer, and reflect the laser rays from the wavelength converting layer to the first polarizer;

the wavelength converting layer converts the laser rays into white laser rays;

the second reflector reflects the white laser rays from the wavelength converting layer to the second polarizer, and reflect the white laser rays from the second polarizer to the wavelength converting layer; and the second reflector lets the white laser rays with a second polarization pass;

the liquid crystal panel lets the white laser rays from the light circulating device pass, and generates projection rays with a predetermined image; and the projection lens projects the projection rays with the predetermined image onto a target.

2. The light module of the laser headlamp of claim 1, further comprising at least a collimator between the laser emitter and the light circulating device to collimate the laser rays from the laser emitter.

3. The light module of the laser headlamp of claim 1, wherein the light circulating device further includes a filter between the laser emitter and the first polarizer to filter out the laser rays with a wavelength beyond a predetermined threshold.

4. The light module of the laser headlamp of claim 3, wherein the filter is a short pass filter.

5. The light module of the laser headlamp of claim 1, wherein the first reflector of the light circulating device has a barrel-like member with a diameter gradually narrowing from an end proximal to the first polarizer to an end proximal to the wavelength converting layer.

6. The light module of the laser headlamp of claim 1, wherein the first reflector of the light circulating device has a barrel-like member with a parabolic interior surface.

7. The light module of the laser headlamp of claim 1, wherein the second reflector of the light circulating device has a barrel-like member with a diameter gradually narrowing from an end proximal to the second polarizer to an end proximal to the wavelength converting layer.

8. The light module of the laser headlamp of claim 1, wherein the second reflector of the light circulating device has a barrel-like member with a parabolic interior surface.

9. The light module of the laser headlamp of claim 1, wherein the wavelength converting layer contains phosphor therein to excite the laser rays to the white laser rays.

* * * * *